US006681928B1

(12) United States Patent
Siek et al.

(10) Patent No.: US 6,681,928 B1
(45) Date of Patent: Jan. 27, 2004

(54) COMPACT DISC PACKAGE SYSTEM AND METHODS FOR PACKAGING THE SAME

(75) Inventors: Sok Eng Siek, Singapore (SG); Toh Hon Cheong, Singapore (SG)

(73) Assignee: Adaptec, Inc., Milpitas, CA (US)

( * ) Notice: Subject to any disclaimer, the term of this patent is extended or adjusted under 35 U.S.C. 154(b) by 88 days.

(21) Appl. No.: 09/972,600

(22) Filed: Oct. 5, 2001

(51) Int. Cl.[7] ..... B65D 85/57
(52) U.S. Cl. ..... 206/308.1; 206/312; 206/309
(58) Field of Search ..... 206/308.1, 308.2, 206/308.3, 309–313, 232, 472, 495, 459.5; 229/68.1, 92.8

(56) References Cited

U.S. PATENT DOCUMENTS 4,709,812 A * 12/1987 Kosterka ..... 206/308.1
4,905,831 A * 3/1990 Bagdis et al. ..... 206/308.3
5,101,973 A * 4/1992 Martinez ..... 206/308.1
5,318,222 A * 6/1994 Bartlett ..... 229/72
5,638,953 A * 6/1997 House ..... 206/308.1
5,662,217 A * 9/1997 Durr ..... 206/308.1
5,685,424 A * 11/1997 Rozek et al. ..... 206/308.1
5,775,490 A * 7/1998 Baker et al. ..... 206/308.1
6,105,762 A * 8/2000 Pettey ..... 206/232

* cited by examiner

*Primary Examiner*—J. Mohandesi
(74) *Attorney, Agent, or Firm*—Martine & Penilla, LLP

(57) ABSTRACT

A package for holding a compact disc (CD). The package is defined by a unitary package piece that is divided into a set of sections, and each of the set of sections is capable of having printed data thereon. The unitary package piece includes a CD holding section defined by a section of the unitary package piece. The CD holding section having a pair of CD support flaps and a CD access cut-out. A set of four sections are part of the unitary package piece, and the set of four sections are defined by a first fold line and a second fold line. The CD holding section is configured to fold and adhere to one of the set of four sections, and the set of four sections are configured to define the package when folded along the first fold line and the second fold line. A locking flap is integral with one of the four sections of the unitary package piece, and the locking flap is configured to hold the package together when folded along the first fold line and the second fold line.

20 Claims, 6 Drawing Sheets

COMPACT DISC PACKAGE SYSTEM AND METHODS FOR PACKAGING THE SAME

BACKGROUND OF THE INVENTION

1. Field of the Invention

The present invention relates to packaging and, more particularly, to a package and a method for packaging software media containing a software application.

2. Description of the Related Art

Software applications are typically delivered to original equipment manufacturers (OEMs) on a computer readable media such as, for example, a compact disc (CD). The computer readable media is typically accompanied by documentation for the end user such as, for example, a registration card, a copyright disclaimer card, and a product information guide. In one known method for packaging software applications for delivery to OEMs, a CD having the software application stored thereon is individually packed along with the accompanying documentation in an envelope-like package. Once verification that the proper inserts have been placed in the package, the package is securely sealed. Thereafter, the package is shipped to an OEM so that the software application can be either installed on or shipped with a computer or other board product.

Although the process is rather straight forward, labor overhead is necessary to ensure that each of the inserts are properly placed in the package, and the correct version documentation is applied to the package. If a version change occurs, the CDs must be replaced with new CDs. In some cases, some of the inserts will be reused, while others may be version specific, and therefore must thrown away. In any case, the envelope will not be reused, since opening the packing envelope will also damage the envelope.

In view of the foregoing, what is needed is a package for packaging a compact disc that efficiently accommodates frequent changes in software recorded on the compact disc, while enabling reuse of substantially all of the original packing material.

SUMMARY OF THE INVENTION

Broadly speaking, the present invention fills this need by providing a package and method for cost effectively packaging a compact disc (CD) containing computer readable data. The package is also configured for easy reuse by simply removing a shrink-wrapping, replacing the CD, and re-shrink-wrapping the package. A label can then be applied to the shrink-wrap. In one aspect of the invention, all text or graphics are applied directly to the package, thus obviating the need for separate inserts and additional labor needed to manage the packing process.

In accordance with one aspect of the present invention, a package for holding a compact disc (CD) is provided. The package is defined by a unitary package piece that is divided into a set of sections, and each of the set of sections is capable of having printed data thereon. The unitary package piece includes a CD holding section defined by a section of the unitary package piece. The CD holding section having a pair of CD support flaps and a CD access cut-out. A set of four sections are part of the unitary package piece, and the set of four sections are defined by a first fold line and a second fold line. The CD holding section is configured to fold and adhere to one of the set of four sections, and the set of four sections are configured to define the package when folded along the first fold line and the second fold line. A locking flap is integral with one of the four sections of the unitary package piece, and the locking flap is configured to hold the package together when folded along the first fold line and the second fold line.

A package for holding a compact disc (CD) containing software for shipping is disclosed. The package is defined from a unitary package piece that is divided into a set of sections, and each of the set of sections is capable of having printed data thereon. The unitary package piece includes a CD holding section defined by a section of the unitary package piece, and the CD holding section has a pair of CD support flaps and a CD access cut-out. A set of four sections are part of the unitary package piece, and the set of four sections is defined by a first fold line and a second fold line. The CD holding section is configured to fold and adhere to one of the set of four sections, and the set of four sections are configured to define the package when folded along the first fold line and the second fold line. A locking flap is further configured to be integral with one of the four sections of the unitary package piece, and the locking flap is configured to hold the package together when folded along the first fold line and the second fold line. Further provided is an adhesive for holding the pair of CD support flaps against the one of the set of four sections of the unitary package piece, and an insert cut is defined into one of the set of four sections. The insert cut is configured to receive the locking flap to hold the package together in a closed state.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE INVENTION

Several exemplary embodiments of the invention will now be described in detail with reference to the accompanying drawings.

Figure 1A:
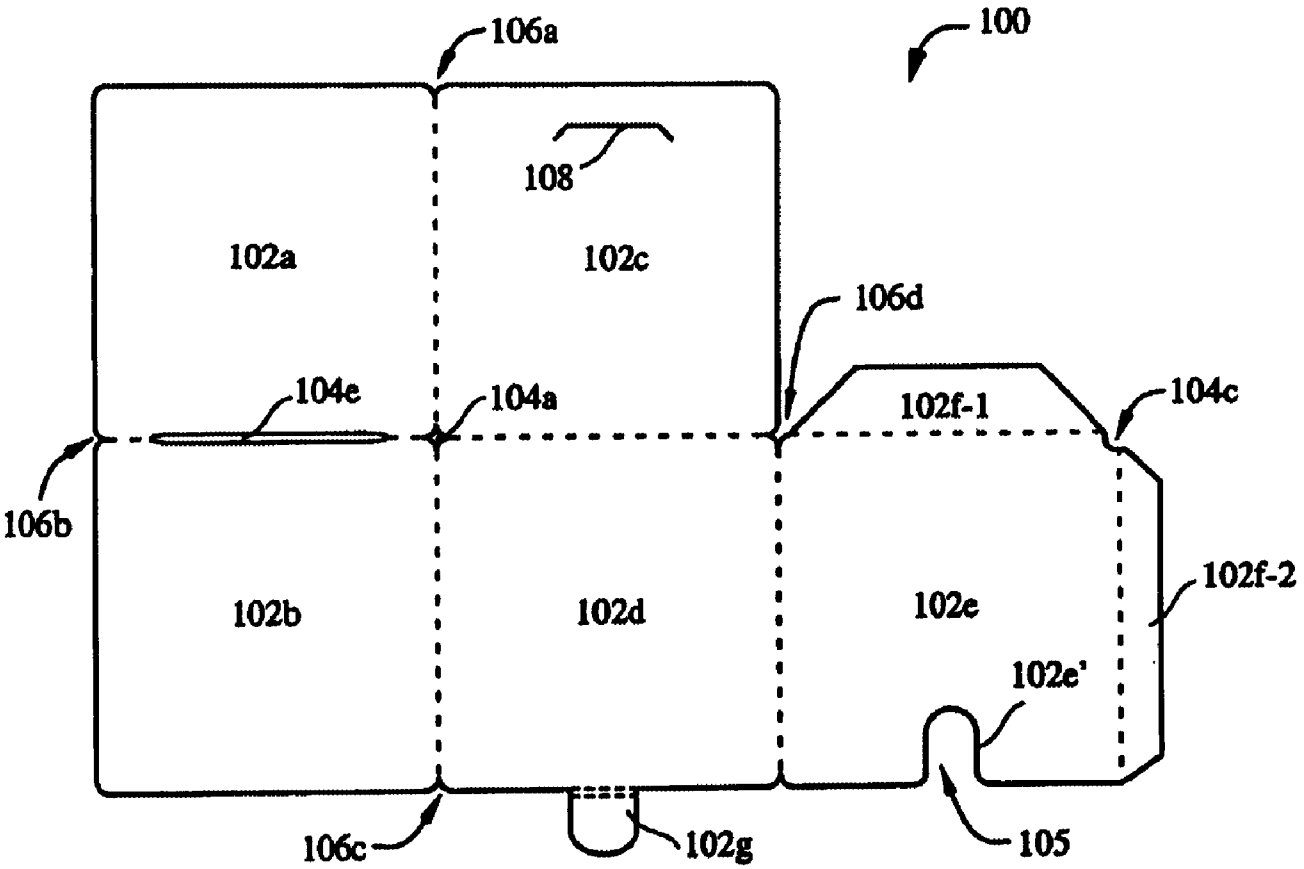
FIG. 1A illustrates an unfolded unitary package 100 for holding a compact disc (CD) for shipping software, in accordance with one embodiment of the present invention.

FIG. 1A illustrates an unfolded package 100 for holding a compact disc (CD) for shipping software, in accordance with one embodiment of the present invention. As shown, the unfolded package 100 has a number of package sections 102*a*, 102*b*, 102*c*, 102*d*, 102*e*, 102*f*-1, 102*f*-2, and 102*g*. Each of the package sections is defined from a unitary piece of material, thus defining a unitary package piece. In one embodiment, the material is a thick paper material having a degree of rigidity, yet capable of being folded. As shown, the unfolded package 100 also includes a number of cut-outs 104*a*–104*d*. Also provided is a CD access cut-out 105 to allow access to the CD once the package is assembled. To ensure that the resulting CD package has the desired shape, edge cuts 106*a*–106*d* are provided. For instance, the edge cuts 106*a*–106*d* allow the finished CD package to have slightly rounded corners, as opposed to sharp edges. The rounding of the corners, as will be explained below, will allow the CD package to be shrink-wrapped with better ease, thus avoiding premature cutting of the shrink-wrap.

Figure 1B:
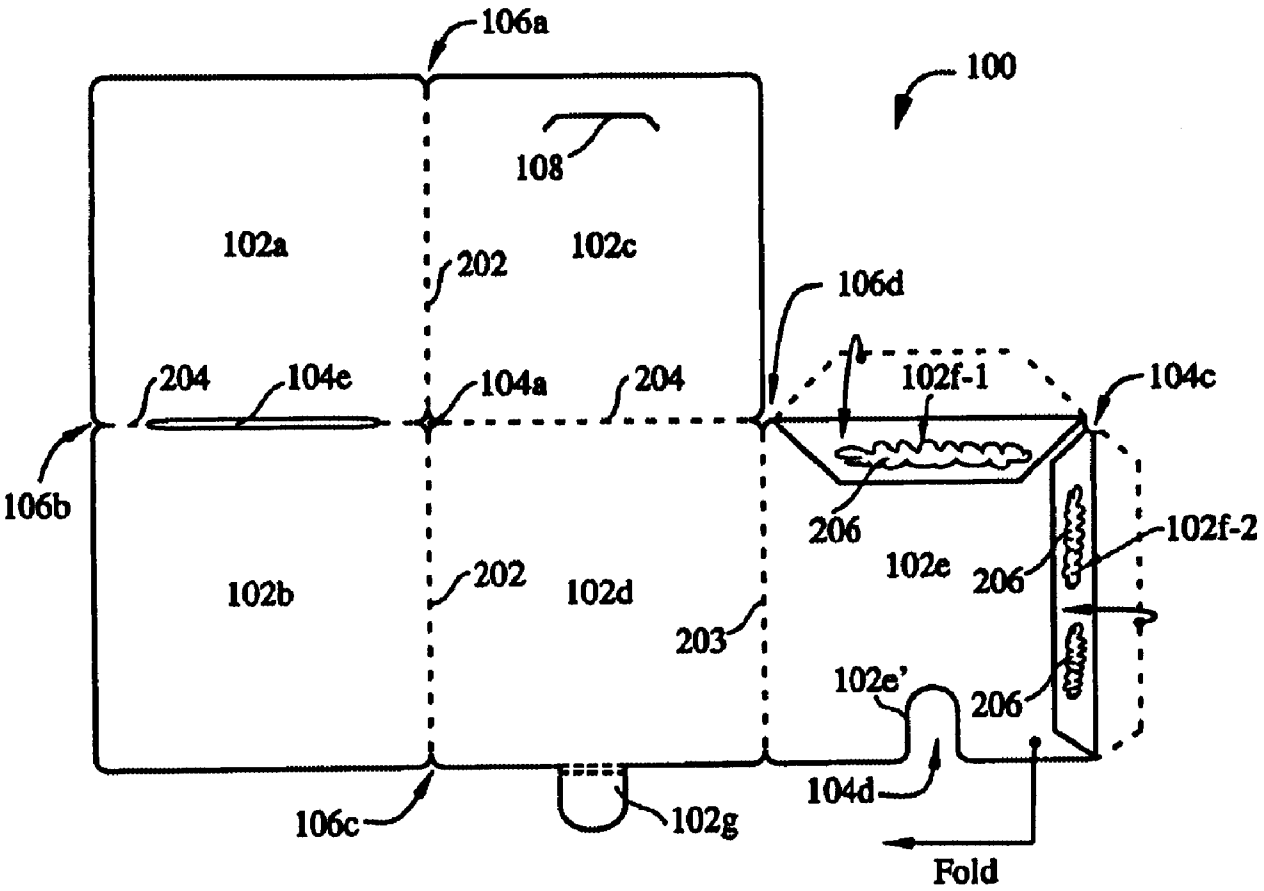
FIG. 1B illustrates the folding of CD support flaps, in accordance with one embodiment of the present invention.

FIG. 1B illustrates the folding of CD support flaps 102*f*-1 and 102*f*-2. Once the CD support flaps 102*f*-1 and 102*f*-2 are folded down and against section 102*e*, which has a cut-out section 102*e*', an adhesive 206 is applied to the folded CD support flaps 102*f*-1 and 102*f*-2. The adhesive 206 will thus allow the CD support flaps 102*f*-1 and 102*f*-2 to stay joined to respective parts of the section 102*d*, once folded along fold line 203. Also illustrated are fold lines 202 and 204, each assisting to divide sections 102*a*, 102*b*, 102*c* and 102*d*. To provide for smoother folds along fold line 204, a cut-out 104*e* is defined along part of the fold line 204.

Figure 2A:
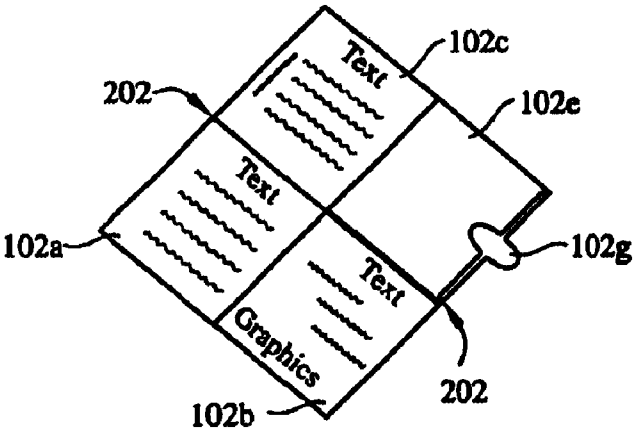
FIG. 2A illustrates the CD package after a section has been folded over and caused to adhere to another section using an adhesive, in accordance with one embodiment of the present invention.

FIG. 2A illustrates the CD package after the section 102*e* has been folded over and caused to adhere to section 102*d* using the adhesive 206. This view also illustrates that the packaging material is not only used to pack the CD for shipping, but also for applying text, graphics, and the like directly on the package. In one embodiment, the CD package is essentially complete once the section 102*e* is adhered to section 102*d*, since the CD can be held within the pouch created by the adhered folded section 102*e*. In practice, the end user of the CD, at the time of unpacking, will be able to unfold the CD package 210 at the point shown in FIG. 2A. Although not shown from this view, text and graphics can also be applied to the reverse side of the package. As used herein, the text and graphics can be used to replace the printed material inserts, such as instructions, license, and other OEM and vender information. Beneficially, there will be no need to insert separate packing materials or employ additional labor to complete the packing process.

Figure 2B:
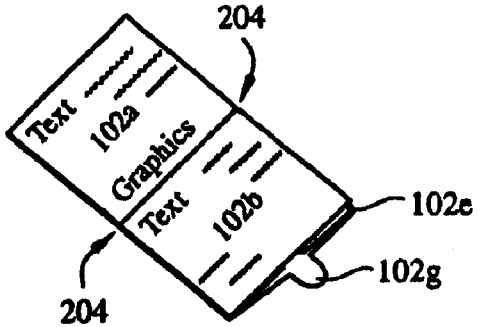
FIG. 2B illustrates the CD package after it has been folded along a fold line, in accordance with one embodiment of the invention.
Figure 2C:
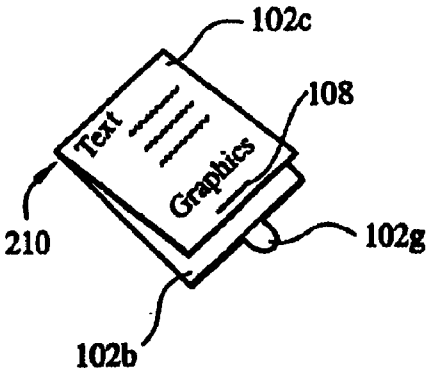
FIG. 2C illustrates the final folding of the CD package before a locking flap is activated, in accordance with one embodiment of the present invention.

FIG. 2B illustrates the CD package 210 after it has been folded along fold line 202. This illustration shows how additional instructions can be written inside of the CD package 210. Essentially, FIG. 2B illustrates the reverse sides of section 102*a* and 102*b*, leaving fold line 204. All along, locking flap 102*g*, remains open awaiting the final fold along fold line 204. Once the fold along fold line 204 is complete, additional graphics, logos, text or instructions can be printed on the backside of section 102*c*. Also evident from the perspective of FIG. 2C is the insert cut 108. The insert cut 108 will be used to receive the locking flap 102*g* at the final stage of folding. It should be noted that the folding that occurred between in FIGS. 2B and 2C are not permanent, thus enabling reuse of the CD package 210. For instance, assuming that the CD needed to be replaced with a new application version, the software originator can simply: (a) unlock the folding flap 102*g*, and (b) slide out the CD from within the pouch created by sections 102*d*, 102*e*, and CD support flaps 102*f*-1 and 102*f*-2. Once removed, a new CD can be inserted and the folding flap 102*g* can be re-inserted into the insert cut in section 102*c*.

Alternatively, the originator can, in addition to (a) unlocking the folding flap 102*g*, the package can be unfolded at fold lines 204 and 202. This will also expose all of the text, graphics and the like. Assuming that the text, install instructions, and license are the same for the new version, the entire CD package 210 can be reused. Furthermore, it is emphasized that the embodiments of the present invention also enable more efficient initial assembly of packing materials, which beneficially lowers packing labor costs.

Figure 3A:
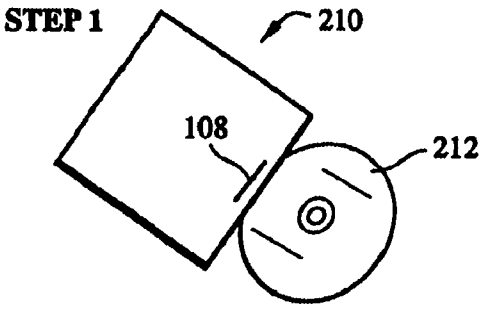
FIGS. 3A–3E illustrate the process of inserting a CD into the CD package, the serial number marking process, the shrink-wrap process, and the final product marking process, in accordance with one embodiment of the present invention.
Figure 3B:
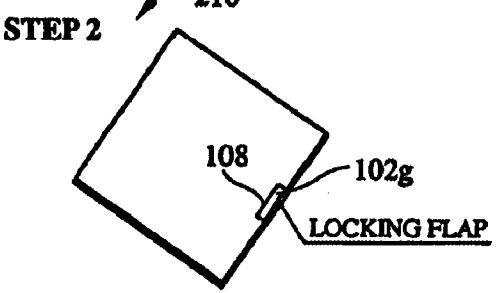
Figure 3C:
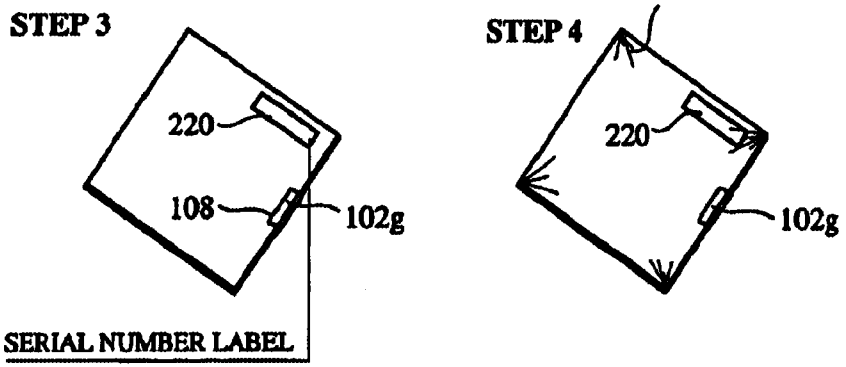

FIGS. 3A–3E illustrate the process of inserting a CD into the CD package 210, serial number marking process, shrink-wrap process, and the final product marking process. As shown in FIG. 3A, a CD 212 is shown being inserted into a CD package 210. In this example, the CD 212 is inserted with the CD package 210 having its locking flap 102*g* undone. As the CD 212 is slid into the CD package 210 (to be held within the pouch created by sections 102*d*, 102*e*, and 102*f*-1 and 102*f*-2), the locking flap 102*g* remains open. In FIG. 3B, the locking flap 102*g* is folded over and caused to be inserted into the insert cut 108. Once inserted, the locking flap 102*g* will keep the CD 212 contained within the CD package 212. FIG. 3C illustrates how the serial number 220 of the software written to the CD 212 is applied directly to the CD package 210. In one embodiment, the serial number will remain the same, no matter if update versions are to be shipped in the same package. Thus, the serial number can be directly applied to the CD package 212, without the need to remove the same.

Figure 3D:
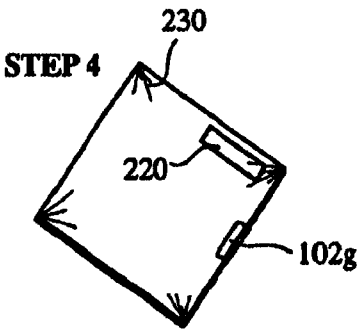
Figure 3E:
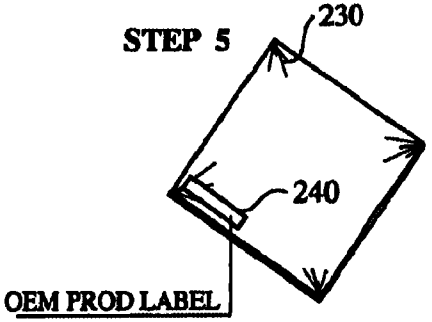

In FIG. 3D, the CD package 212 is processed through a shrink-wrap machine. The shrink-wrapping 230 will ensure that the CD package 212 will only be opened by a consumer that intends to abide by the shrink-wrapping license. Once the shrink-wrapping 230 is applied, a product label 240 is applied to the shrink-wrapping. Because the product label 240 will change depending on the version being shipped in the CD package 210, the product label 240 will not be adhered directly to the CD package 210, which can damage the appearance if removed (e.g., by pealing off and the like).

Figure 4:
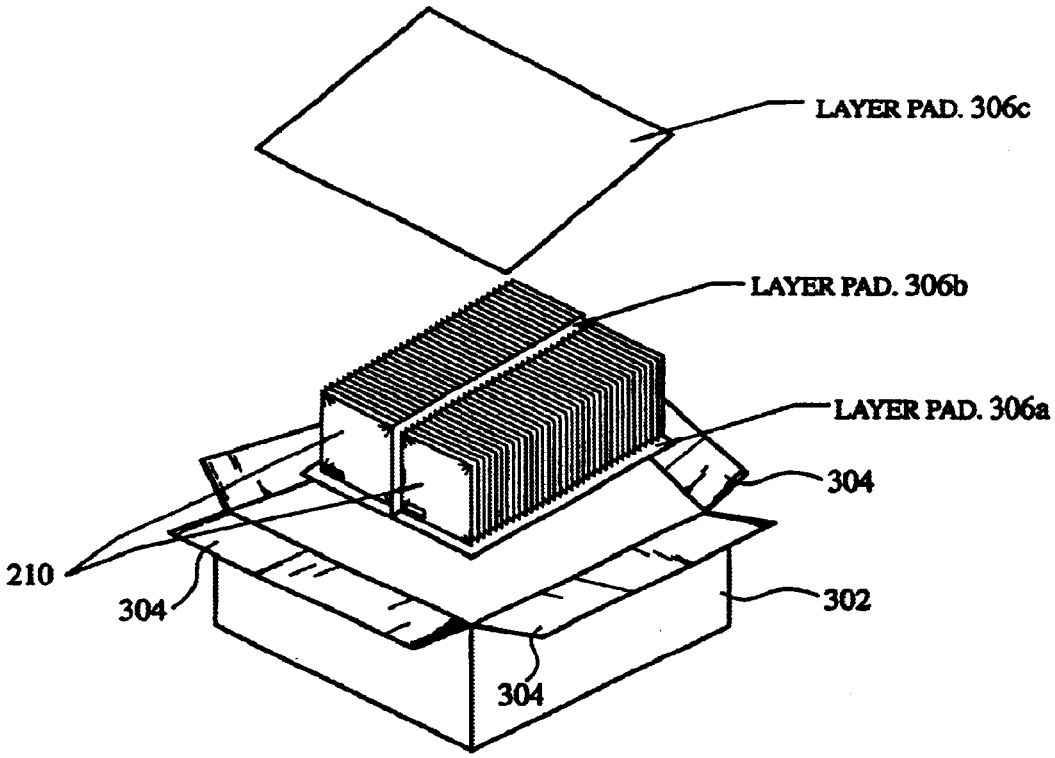
FIG. 4 illustrates yet another packing embodiment, in accordance with one embodiment of the present invention.

FIG. 4 illustrates yet another packing embodiment, in accordance with one embodiment of the present invention. As shown, packed CDs, such as those illustrated in FIG. 3E, can then be efficiently bulk packaged in a carton 302. To efficiently pack the CDs 212, a layer pad 306*a* is first placed into the base of the carton 302. A layer pad 306*b*, is then placed between rows of CD packages 210. In one embodiment, 50 pieces of packaged CDs are placed in each of the two rows. In a preferred embodiment, the locking flaps 102*g* are placed facing the layer pad 306*b*. Once the CDs 212 have been placed into the carton 302, a layer pad 306*c* is placed over the CDs 212. Carton flaps 304 are then closed and subject to sealing. The carton 302, holding 100 packaged CDs, can then be shipped to a recipient.

Figure 5:
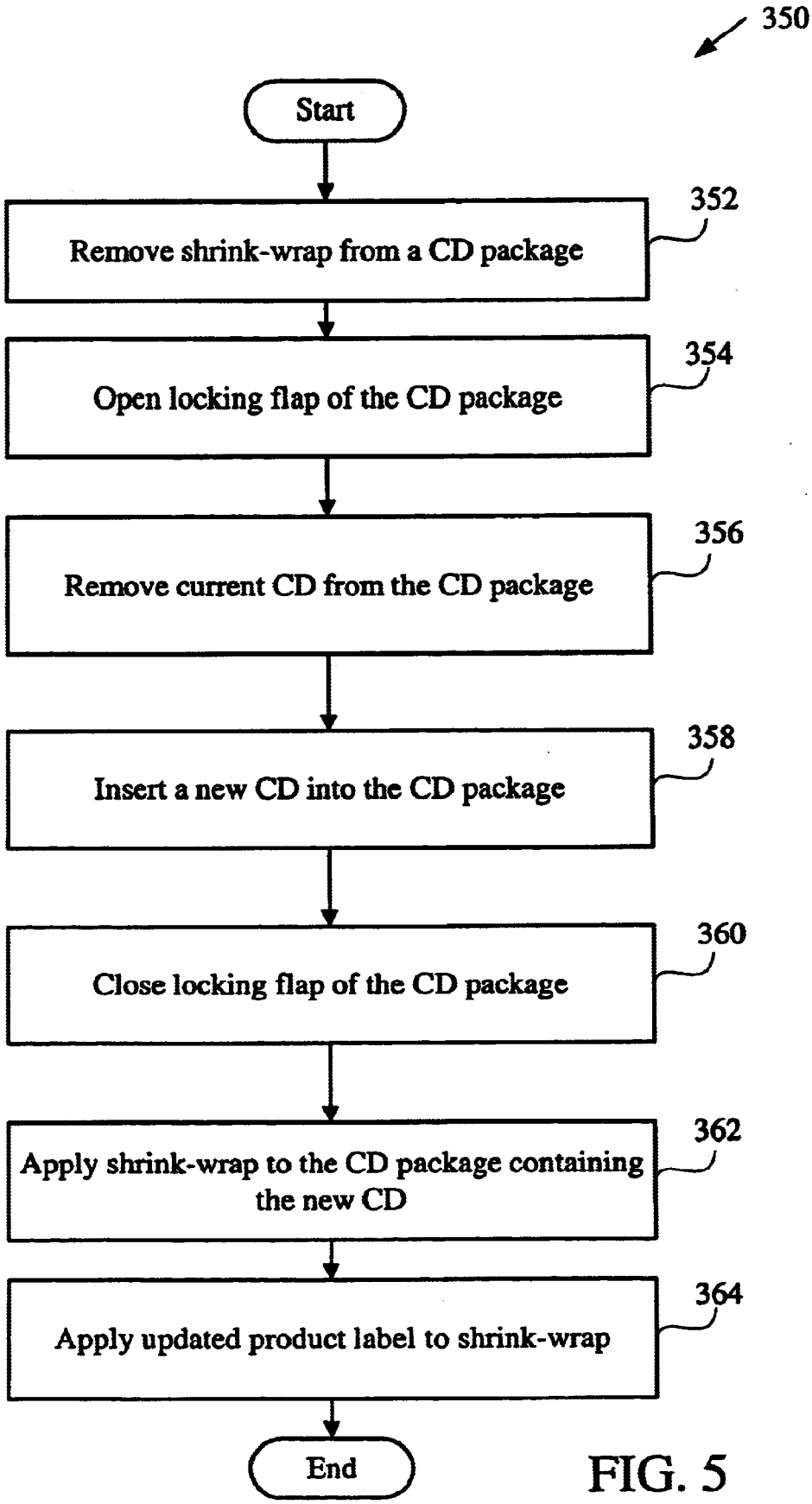
FIG. 5 is a flowchart illustrating the versatility of the CD package, in accordance with one embodiment of the present invention.

FIG. 5 is a flowchart 350 illustrating the versatility of the CD package 210, in accordance with one embodiment of the present invention. Flowchart 350 illustrates a method for reusing a CD package 210 which holds a CD having dated software, thus needing an upgraded version of the software by way of a replacement CD. Assuming a CD package 210 has been previously packaged as discussed in FIGS. 1–4, the method in operation 352 proceeds to where the shrink-wrapping is removed from the CD package. In operation 354, the locking flap is opened to allow access to the CD. In operation 356, the current CD is removed from the CD package 210. If desired, the CD package 210 can be unfolded as discussed above, or can simply be opened to allow removal of the CD by opening the locking flap. In operation 358, a new CD is inserted into the CD package. The new CD, in one embodiment, can represent the CD containing upgraded software or new data. For purposes of clarity, the CD can contain any type of date, whether it be audio, software code, or user data.

In operation 360, once the new CD is inserted into the CD package 210, the locking flap is folded to close the package containing the new CD. In operation 362, shrink-wrapping is applied to the CD package 210 containing the new CD. Finally, an updated product label is applied to the shrink-wrapping, for example, to apply and OEM product label (e.g., containing a product part number and revision). At this point, the reused CD package 210 can individually be shipped to an end user, e.g., an OEM, or can be packed into a carton for bulk shipping.

It should be noted that the packaging methodology of the present invention enables very efficient reuse of the entire CD package 210. Notably, any instructions on use of the packed CD can be printed directly onto the CD package. To provide additional space for the documentation, the CD package 210 can be printed on a number of sides, both internal and external. This therefore eliminates the need to separately pack instruction materials, license documentation, and the like. Having less inserts provides for more efficient use of labor to complete the CD package or reuse the CD package once an upgrade is needed. Also important to note is that the CD package can be reused any number of times, so long as the instructions and/or license printed on the package itself are current. The product label 240, which does change with version number, is conveniently applied to the shrink-wrapping, which is replaced anytime an upgrade occurs.

The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims.

What is claimed is:

1. A package, comprising:

a unitary package piece being divided into a set of sections, each of the set of sections capable of having printed data thereon, the unitary package piece including, a CD holding section defined by a section of the unitary package piece, the CD holding section having a pair of CD support flaps and a CD access cut-out;

a set of four sections all joined together and being part of the unitary package piece, the set of four sections being defined by a first fold line and a second fold line, and the first fold line being perpendicular to, and intersecting through the second fold line, and the CD holding section being configured to fold and adhere to one of the set of four sections, the set of four sections being configured to define the package when folded along the first fold line and the second fold line; and a locking flap being integral with one of the four sections of the unitary package piece, the locking flap being configured to hold the package together when folded along the first fold line and the second fold line.

2. The package as recited in claim 1, further comprising:

an adhesive for holding the pair of CD support flaps against the one of the set of four sections of the unitary package piece.

3. The package as recited in claim 2, further comprising:

an insert cut defined into one of the set of four sections, the insert cut being configured to receive the locking flap to hold the package together in a closed state.

4. The package as recited in claim 2, further comprising:

a shrink-wrap cover, the shrink-wrap cover being configured to contain the package and prevent access to the locking flap without cutting the shrink-wrap cover.

5. The package as recited in claim 4, further comprising:

a label being attached to the shrink-wrap.

6. The package as recited in claim 1, further comprising:

a compact disc configured to be held within the package.

7. The package as recited in claim 1, wherein the printed data is configured to replace package inserts, such that no literature insert is contained in the package.

8. The package as recited in claim 1, wherein the unitary package piece, when folded along the first fold line and the second fold line, is about the size of a compact disc.

9. The package as recited in claim 4, wherein a plurality of packages made from the unitary package piece containing compact discs are further packaged into a carton.

10. A compact disc package, comprising:

a unitary package piece being divided into a set of sections, each of the set of sections capable of having printed data thereon, the unitary package piece including, a CD holding section defined by a section of the unitary package piece, a set of four sections all joined together and being part of the unitary package piece, the set of four sections being defined by a first fold line and a second fold line, and the first fold line being perpendicular to, and intersecting through the second fold line, and the CD holding section being configured to fold and adhere to one of the set of four sections, the set of four sections being configured to define the package when folded along the first fold line and the second fold line; and a locking flap being integral with one of the four sections of the unitary package piece, the locking flap being configured to hold the package together when folded along the first fold line and the second fold line.

11. A compact disc package as recited in claim 10, further comprising:

a pair of CD support flaps defined in the CD holding section.

12. A compact disc package as recited in claim 10, further comprising:

a CD access cut-out being defined in the CD holding section.

13. A compact disc package as recited in claim 10, further comprising:

an adhesive for holding a pair of CD support flaps against the one of the set of four sections of the unitary package piece.

14. A compact disc package as recited in claim 13, further comprising:

an insert cut defined into one of the set of four sections, the insert cut being configured to receive the locking flap to hold the package together in a closed state.

15. A compact disc package as recited in claim 14, further comprising:

a shrink-wrap cover, the shrink-wrap cover being configured to contain the package and prevent access to the locking flap without cutting the shrink-wrap cover.

16. A compact disc package as recited in claim 15, further comprising:

a label being attached to the shrink-wrap.

17. A compact disc package as recited in claim 10, further comprising:

a compact disc configured to be held within the package.

18. A compact disc package as recited in claim 10, wherein the printed data is configured to replace package inserts, such that no literature insert is contained in the package.

19. The package as recited in claim 10, wherein the unitary package piece, when folded along the first fold line and the second fold line, is about the size of a compact disc.

20. A package for holding a compact disc (CD) containing software for shipping, comprising:

a unitary package piece being divided into a set of sections, each of the set of sections capable of having printed data thereon, the unitary package piece including, a CD holding section defined by a section of the unitary package piece, the CD holding section having a pair of CD support flaps and a CD access cut-out;

a set of four sections all joined together and being part of the unitary package piece, the set of four sections being defined by a first fold line and a second fold line, and the first fold line being perpendicular to, and intersecting through the second fold line, and the CD holding section being configured to fold and adhere to one of the set of four sections, the set of four sections being configured to define the package when folded along the first fold line and the second fold line;

a locking flap being integral with one of the four sections of the unitary package piece, the locking flap being configured to hold the package together when folded along the first fold line and the second fold line;

an adhesive for holding the pair of CD support flaps against the one of the set of four sections of the unitary package piece; and an insert cut defined into one of the set of four sections, the insert cut being configured to receive the locking flap to hold the package together in a closed state.

* * * * *